US009157304B2

(12) United States Patent
Parsche

(10) Patent No.: US 9,157,304 B2
(45) Date of Patent: Oct. 13, 2015

(54) HYDROCARBON RESOURCE RECOVERY SYSTEM INCLUDING RF TRANSMISSION LINE EXTENDING ALONGSIDE A WELL PIPE IN A WELLBORE AND RELATED METHODS

(71) Applicant: Harris Corporation, Melbourne, FL (US)

(72) Inventor: Francis E. Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 429 days.

(21) Appl. No.: 13/692,263

(22) Filed: Dec. 3, 2012

(65) Prior Publication Data

US 2014/0151028 A1 Jun. 5, 2014

(51) Int. Cl.
*E21B 43/24* (2006.01)
*H05B 6/72* (2006.01)

(52) U.S. Cl.
CPC ..... *E21B 43/2401* (2013.01); *E21B 43/2408* (2013.01); *H05B 6/72* (2013.01); *E21B 43/2406* (2013.01); *H05B 2214/03* (2013.01)

(58) Field of Classification Search
CPC ..... E21B 43/2408; E21B 43/2401
See application file for complete search history.

(56) References Cited

U.S. PATENT DOCUMENTS

| | | | | |
|---|---|---|---|---|
| 2,283,914 | A | 5/1942 | Carter | |
| 2,757,738 | A * | 8/1956 | Ritchey | 166/248 |
| 3,522,847 | A * | 8/1970 | New | 166/60 |
| 4,793,409 | A | 12/1988 | Bridges et al. | |
| 7,441,597 | B2 | 10/2008 | Kasevich | |
| 7,692,428 | B2 | 4/2010 | Clark et al. | |
| 7,891,421 | B2 | 2/2011 | Kasevich | |
| 2007/0187089 | A1 * | 8/2007 | Bridges | 166/248 |
| 2009/0242196 | A1 * | 10/2009 | Pao | 166/248 |
| 2010/0078163 | A1 | 4/2010 | Banerjee et al. | |
| 2010/0294488 | A1 | 11/2010 | Wheeler et al. | |
| 2010/0294489 | A1 | 11/2010 | Dreher, Jr. et al. | |
| 2010/0314106 | A1 | 12/2010 | Tubel | |
| 2011/0253370 | A1 * | 10/2011 | Banerjee et al. | 166/272.3 |
| 2011/0309988 | A1 | 12/2011 | Parsche | |
| 2011/0309990 | A1 | 12/2011 | Parsche | |
| 2012/0061383 | A1 | 3/2012 | Parsche | |
| 2012/0067580 | A1 | 3/2012 | Parsche | |
| 2012/0125607 | A1 | 5/2012 | Parsche | |
| 2014/0151029 | A1 | 6/2014 | Parsche | |

FOREIGN PATENT DOCUMENTS

| | | |
|---|---|---|
| WO | 2007147053 | 12/2007 |
| WO | 2012067770 | 5/2012 |

* cited by examiner

*Primary Examiner* — Shane Bomar
*Assistant Examiner* — George Gray
(74) *Attorney, Agent, or Firm* — Allen, Dyer, Doppelt, Milbrath & Gilchrist, P.A.

(57) ABSTRACT

A hydrocarbon resource recovery system for a laterally extending wellbore in a subterranean formation may include a radio frequency (RF) source and an electrically conductive well pipe extending within the laterally extending wellbore. The hydrocarbon resource recovery system may further include an RF transmission line coupled to the RF source and extending alongside in parallel with an exterior of the electrically conductive well pipe within the laterally extending wellbore. The RF transmission line may be coupled to the electrically conductive well pipe to define an RF antenna for heating the hydrocarbon resources within the subterranean formation.

17 Claims, 6 Drawing Sheets

HYDROCARBON RESOURCE RECOVERY SYSTEM INCLUDING RF TRANSMISSION LINE EXTENDING ALONGSIDE A WELL PIPE IN A WELLBORE AND RELATED METHODS

FIELD OF THE INVENTION

The present invention relates to the field of hydrocarbon resource processing, and, more particularly, to hydrocarbon resource processing devices using radio frequency application and related methods.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in sands where their viscous nature does not permit conventional oil well production. This category of hydrocarbon resource is generally referred to as oil sands. Estimates are that trillions of barrels of oil reserves may be found in such oil sand formations.

In some instances, these oil sand deposits are currently extracted via open-pit mining. Another approach for in situ extraction for deeper deposits is known as Steam-Assisted Gravity Drainage (SAGD). The heavy oil is immobile at reservoir temperatures, and therefore, the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen, which allows it to flow down into the lower producer well where it is collected and recovered. The steam and gases rise due to their lower density. Gases, such as methane, carbon dioxide, and hydrogen sulfide, for example, may tend to rise in the steam chamber and fill the void space left by the oil defining an insulating layer above the steam. Oil and water flow is by gravity driven drainage urged into the lower producer well.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Patent Application No. 2010/0294489 to Dreher, Jr. et al. discloses using microwaves to provide heating. An activator is injected below the surface and is heated by the microwaves, and the activator then heats the heavy oil in the production well. U.S. Published Patent Application No. 2010/0294488 to Wheeler et al. discloses a similar approach.

U.S. Pat. No. 7,441,597 to Kasevich discloses using a radio frequency generator to apply radio frequency (RF) energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

U.S. Pat. No. 7,891,421, also to Kasevich, discloses a choke assembly coupled to an outer conductor of a coaxial cable in a horizontal portion of a well. The inner conductor of the coaxial cable is coupled to a contact ring. An insulator is between the choke assembly and the contact ring. The coaxial cable is coupled to an RF source to apply RF energy to the horizontal portion of the well.

U.S. Patent Application Publication No. 2011/0309988 to Parsche discloses a continuous dipole antenna. More particularly, Parsche disclose a shielded coaxial feed coupled to an AC source and a producer well pipe via feed lines. A nonconductive magnetic bead is positioned around the well pipe between the connection from the feed lines.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which may impact the environment. Limited water resources may also limit oil recovery. SAGD is also not an available process in permafrost regions, for example, or in areas that may lack sufficient cap rock, are considered "thin" payzones, or payzones that have interstitial layers of shale.

Additionally, production times and efficiency may be limited by post extraction processing of the recovered oil. More particularly, oil recovered may have a chemical composition or have physical traits that may require additional or further post extraction processing as compared to other types of oil recovered.

SUMMARY OF THE INVENTION

In view of the foregoing background, it is therefore an object of the present invention to more efficiently recover hydrocarbon resources from a subterranean formation and while potentially using less energy and providing faster recovery of the hydrocarbons.

This and other objects, features, and advantages in accordance with the present invention are provided by a hydrocarbon resource recovery system for a laterally extending wellbore in a subterranean formation. The hydrocarbon resource recovery system includes a radio frequency (RF) source, and an electrically conductive well pipe extending within the laterally extending wellbore. The hydrocarbon resource recovery system also includes an RF transmission line coupled to the RF source and extending alongside in parallel with an exterior of the electrically conductive well pipe within the laterally extending wellbore and coupled to the electrically conductive well pipe to define an RF antenna for heating the hydrocarbon resources within the subterranean formation. Accordingly, the hydrocarbon resources are heated in the subterranean formation, which advantageously may increase hydrocarbon recovery efficiency, and thus reduce overall production times. For example, the hydrocarbon resource recovery system may be used with a producer well and may also have an injector well to further increase efficiency.

The RF transmission line may include a coaxial transmission line including an inner conductor, an outer conductor surrounding the inner conductor, and a dielectric therebetween. The outer conductor may be coupled to the electrically conductive well pipe, for example. The inner conductor may extend outwardly beyond a distal end of the outer conductor to couple to the electrically conductive well pipe.

The hydrocarbon resource recovery system may further include a capacitor coupled in series between the inner conductor and the electrically conductive well pipe, for example.

A method aspect is directed to a method of recovering hydrocarbon resources in a subterranean formation. The method includes positioning an electrically conductive well pipe extending within a laterally extending wellbore in the subterranean formation. The method further includes positioning a radio frequency (RF) transmission line alongside in parallel with an exterior of the electrically conductive well pipe within the laterally extending wellbore and electrically coupling the RF transmission line to the electrically conductive well pipe to define an RF antenna for recovering the hydrocarbon resources within the subterranean formation. The method also includes supplying RF power to the RF transmission line.

DETAILED DESCRIPTION OF THE PREFERRED EMBODIMENTS

Figure 1:
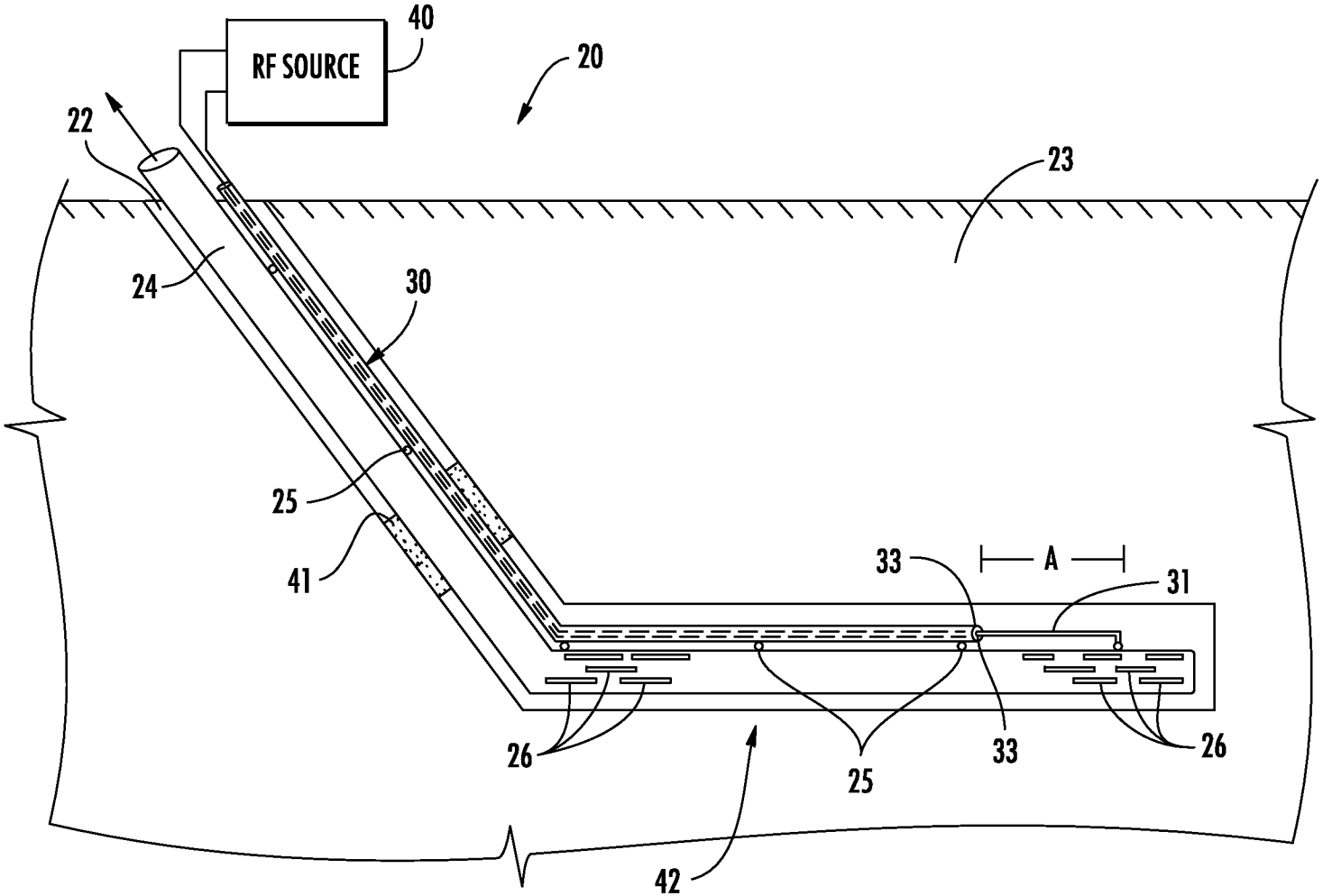
FIG. 1 is a schematic diagram of a subterranean formation including a hydrocarbon resource recovery system in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation is used to indicate similar elements in alternative embodiments.

A hydrocarbon resource recovery system 20 includes a laterally extending wellbore 22 in a subterranean formation 23 containing a hydrocarbon resource. The hydrocarbon resource recovery system 20 includes an electrically conductive well pipe 24 having a tubular shape, and is positioned within the laterally extending wellbore 22 or producer wellbore. The electrically conductive well pipe 24 may be carbon steel, for example, or may be other conductive materials.

A radio frequency (RF) transmission line 30 extends alongside in parallel with an exterior of the electrically conductive well pipe 24 within the laterally extending wellbore 22. More particularly, the RF transmission line 30 is carried by the electrically conductive well pipe 24. The electrically conductive well pipe 24 extends beyond a distal end of RF transmission line 30. In other words, the RF transmission line 30 is shorter in length than the electrically conductive well pipe 24.

The RF transmission line 30 is coupled to the electrically conductive well pipe 24 with mechanical fasteners 25 or clamps, which may be electrically conductive for example. In some embodiments, the mechanical fasteners 25 may be spaced along the length of the RF transmission line 30. Of course, other techniques may be used to couple the RF transmission line 30 to the electrically conductive well pipe 24. Moreover, in some embodiments, the RF transmission line 30 may not be carried by the electrically conductive well pipe 24 and may be spaced apart from and alongside in parallel with the electrically conductive well pipe in the laterally extending wellbore 22.

The hydrocarbon resource recovery system 20 also includes a radiofrequency (RE) source 40 coupled to the electrically conductive well pipe 24 to define an RF antenna for heating the hydrocarbon resources within the subterranean formation 23, as will be explained in further detail below. The RF source 40 is illustratively above the subterranean formation.

The RF transmission line 30 is preferentially in the form a shielded RF transmission line, such as a coaxial transmission line, and includes an inner conductor 31, an outer conductor 33, and a dielectric 32 therebetween. The outer conductor 33 is coupled to the electrically conductive well pipe 24. For example, where mechanical fasteners 25 are used to couple the RF transmission line 30 to the electrically conductive well pipe 24, the mechanical fasteners are electrically conductive and couple to the outer conductor 33 along the length of the RF transmission line. Of course, other techniques to couple the outer conductor 33 to the electrically conductive well pipe 24 may be used. The outer conductor 33 may have a thickness greater than several radio frequency skin depths, so that the exterior surfaces of the RF transmission line 30 may increasingly convey RF heating electrical currents as a common mode type electrical current. At radio frequencies, a coaxial transmission line, for example, may carry independent electrical currents on the inside and outside surfaces of the shield tube. The present embodiments may advantageously use the independent electrical current for increasing efficiency from the RF transmission line 30 as a field and/or current applying portion of the RF heating transducer.

The inner conductor 31 extends outwardly beyond a distal end of the outer conductor 33. The inner conductor 31 is coupled to the electrically conductive well pipe 24. The inner conductor 31 "taps" the electrically conductive well pipe 24 to feed the well pipe as an antenna. In other words, the RF transmission line 30 is coupled to the electrically conductive well pipe 24 to define a dipole antenna 42, or a partially folded dipole. The length of the dipole antenna 24 is preferentially a half wavelength or a harmonic thereof, e.g. $f_0$, $2f_0$, $3f_0$ . . . . Advantageously, there is no driving discontinuity or isolator/insulator within the electrically conductive well pipe 24, and a shunt rather than a series dipole feed is realized by the inner conductor "tap".

A dipole antenna may be preferred for hydrocarbon resource extraction since it has a nearly one dimensional line structure that may be a particularly good fit for the elongate well bore shapes, for example. The divergence of electric current of a dipole creates three near fields: a magnetic near field near the current maxima along the dipole, a circular electric near field near the voltage maxima and a strong radial electric near field, especially near the dipole ends. The ratio of the amplitude of the electric and magnetic near field vary along most dipoles as they commonly have a sinusoidal current distribution. Maximum magnetic near field amplitude occurs near the dipole structure current maxima, and minimum electric near field amplitude occurs near the dipole structure voltage maxima.

When applying RF power, far field radio waves may not be formed as the electromagnetic energies can be dissipated by the hydrocarbon resources or ore before they reach the far field region, which is generally more than $\lambda/2\pi$ or 0.16 wavelengths away from the dipole conductor. Application of RF power may be predominately by near fields, and the ratio of the electric to magnetic near fields can be varied in the near field.

A loop type of radio frequency well heater or antenna may operate by the curl of electric current as it may generate relatively strong magnetic near fields and weaker electric near fields. Loops may be more difficult to implement in the subterranean formation due to their two plus dimensional shape.

The distance A between the distal end of the outer conductor 33 and the coupling location of the inner conductor 31 to the electrically conductive well pipe 24 determines resistance. More particularly, the longer the distance A, the higher the electrical coupling and the higher the electrical load resistance obtained. Fifty ohms of electrical load resistance may be obtained if desired. Advantageously, the electrical load resistance may be adjusted for many hydrocarbon ores of varying electrical conductivity. For example, for a given load resistance, such as 50 ohms, a longer distance A may be desired for a higher electrical conductivity, and a shorter distance A may be desired for a lower electrical conductivity. Thus enhanced oil recovery (EOR) in many grades and types of hydrocarbon ores may be achieved. Prior art center fed half dipole RF heaters that use a center driving discontinuity, for example, may not allow for the adjustment of electrical load resistance, and thus for a highly conductive ore, the load resistance obtained may be impractically low.

A balun 41 surrounds the electrically conductive well pipe 24 and the RF transmission line 30 between the walls of the laterally extending wellbore 22. The balun 41 may be in the form of one or more toroidal windings and/or a ferrous sleeve. The balun 41 may comprise a ferrite, or iron powder in cement, for example. A quarter wavelength long conductive electrical tubing, coupled to the RF transmission line 30 at one end, may be a balun 41. The balun 41 advantageously determines where RF heating of the subterranean formation 23 stops, and thus it may be particularly advantageous to couple the balun adjacent the lateral bend in the laterally extending wellbore 22. The balun 41 also determines the electrical length of the dipole antenna 42, and sets the resonant frequency of the dipole antenna. The electrical conductivity, and therefore heating potential of overburden, is generally greater than that of hydrodrocarbon ore making the balun 41 increasingly desirable.

In some embodiments, a tubular dielectric liner may be positioned in the laterally extending wellbore 22 so that the RF transmission line 30 and the electrically conductive well pipe 24 extend within the tubular dielectric liner. Additionally, the tubular dielectric liner may have openings therein for draining, oil entry, injection of production enhancing fluids, etc.

The electrically conductive well pipe 24 may have hydrocarbon resource passageways 26 or slots or openings therein. A pump may be used to recover hydrocarbon resources from the subterranean formation 23 after heating via the openings 26. Illustratively, the electrically conductive well pipe 24 has the openings 26 at opposing ends of the laterally extending portion. Of course, the openings 26 may be positioned elsewhere along the electrically conductive well pipe 24 for recovering different types of hydrocarbon resources, as will be explained in detail below.

Figure 2:
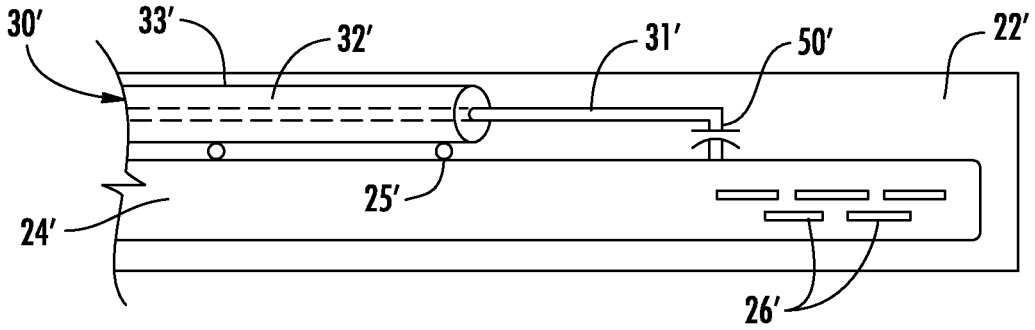
FIG. 2 is a schematic diagram of a distal end portion of an RF transmission line and an electrically conductive well pipe in accordance with another embodiment of the present invention.

Referring now to FIG. 2, in another embodiment, a capacitor 50' is coupled between the inner conductor 31' and the electrically conductive well pipe 24'. The capacitor 50' may be used to increase resistance, for example. The capacitor 50' may be particularly advantageous when processing or recovering low conductivity hydrocarbon resources. The capacitor 50' may be used to buck or cancel unwanted inductive reactance caused by a long tapping dimension A, as may be desired in highly conductive hydrocarbon ores. The capacitor 50' may also be embodied as a sleeve or piston type, a plate capacitor, or other type of capacitor. A vacuum dielectric may be particularly desirable for higher power operation.

Figure 3:
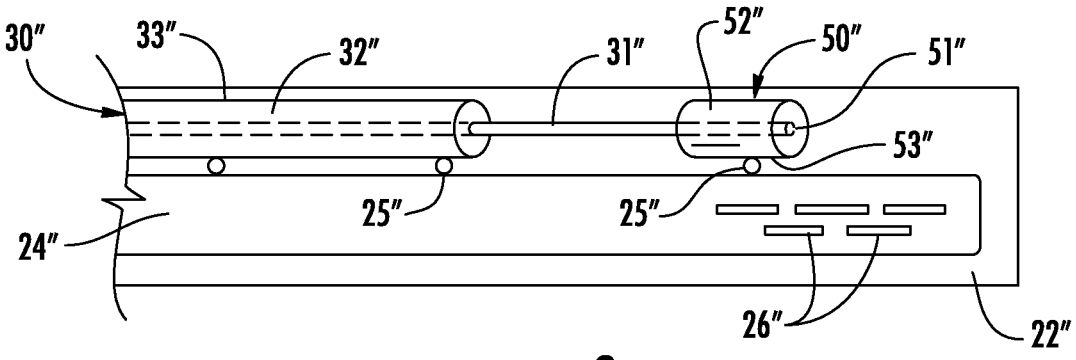
FIG. 3 is a schematic diagram of a distal end portion of an RF transmission line and an electrically conductive well pipe in accordance with yet another embodiment of the present invention.

Referring now to FIG. 3, in another embodiment, the capacitor may be a coaxial capacitor 50". The coaxial capacitor may include an inner conductor 51" and an outer conductor 53" separated by a dielectric 52". The outwardly extended inner conductor 31" of the coaxial RF transmission line 30" is illustratively coupled to the inner conductor 51" of the coaxial capacitor 50". The outer conductor 53" of the coaxial capacitor 50" is coupled to the electrically conductive well pipe 24".

Figure 4:
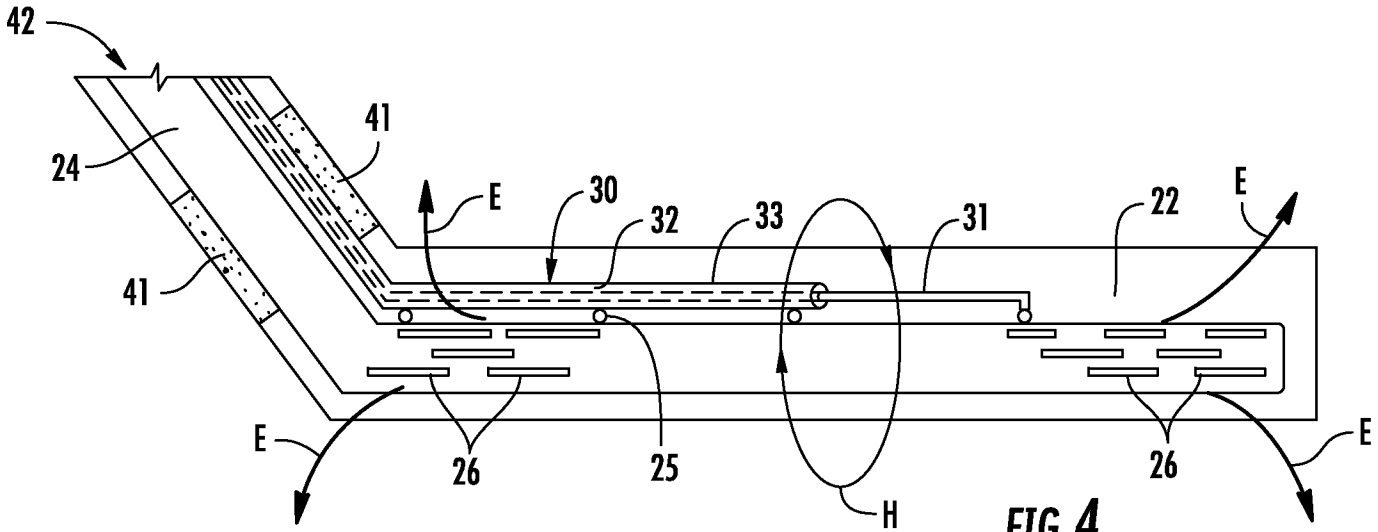
FIG. 4 is another schematic diagram of the hydrocarbon resource recovery system of FIG. 1 illustrating electric and magnetic fields.

Referring now additionally to FIG. 4, the openings 26 may be positioned to recover different types of hydrocarbon resources. Relatively high voltages and strong or higher electric field strength regions E are generated at the ends of the dipole antenna 42. The higher electric field strength regions E have a higher electric field strength and a lower magnetic field strength. Relatively high currents and a relatively strong, or a higher magnetic field strength region H, is generated at the center or medial portion of the dipole antenna 42. The higher magnetic field strength region H has a higher magnetic field strength and a lower electric field strength. Quantitatively, the end regions of the dipole may have an electric field strength to magnetic field strength ratio, expressed mathematically as E/H, ranging from about 5000 to 100,000. The center regions of the dipole may have an electric field strength to magnetic field strength ratio E/H ranging from about 50 to 2000. The exact value of the E to H ratio depends mostly on the electrical conductivity of the hydrocarbon resources, and also may be based upon the relative permittivity of the hydrocarbon resources, the pipe diameter, electrical surface insulation on the dipole conductor (if any), and degree of connate water boil off (if any). The absolute values of the electric and magnetic fields (but not the ratio) may depend on strength of the RF power level in watts applied by radio frequency (RF) source 40 applied to the dipole antenna 42. A finite element numerical electromagnetic analysis was performed for a dipole immersed in hydrocarbon resources or ore with results as follows:

| Example Electric and Magnetic Field Strengths | | |
|---|---|---|
| System type | Half wave dipole hydrocarbon payzone | |
| Method | Finite element simulation | |
| Hydrocarbon ore | Rich Athabasca oil sand (contains connate pore water) | |
| Ore relative permittivity | 6 | dimensionless |
| Ore relative permeability | 1 | dimensionless |
| Ore electrical conductivity | 0.002 | Mhos per meter |
| Dipole type | Center fed half wave in media | |
| Dipole length | 1000 | feet |
| Dipole diameter | 10 | inches |
| Insulation | Dry ore/connate water was boiled off antenna surfaces prior to initiation of RF heating. Insulating materials such as polyimide may also be used. | |
| Dipole fundamental resonance frequency in ore | Approximately 240 | Kilohertz |
| Applied RF power | 5 | megawatts |
| Current distribution along dipole | Sinusoidal with current maxima at center, current minimas at ends | |
| Type of applied electromagnetic fields | Near reactive | |
| E field strength near the ends of the dipole | 23 | Kilovolts per meter, peak to peak |
| H field strength near the ends of the dipole | 0.07 | Amps per meter, peak to peak |
| E field strength near the center of the dipole | 1280 | Volts per meter, peak to peak |
| H field strength near the center of the dipole | 1.7 | Amps per meter, peak to peak |
| Field impedance near dipole ends | 23000/0.07 = 32,857 | Ohms |
| Field impedance near dipole center | 1280/1.7 = 752 | Ohms |
| Dipole load impedance at center driving point | 390 + j10 | Ohms |
| Voltage across dipole center insulator | 44 | kilovolts |

The applied RF power of 5 megawatts in this example is a relatively high power level example for rapid startup. Slower startup may be accomplished at about 1.5 kilowatts of RF power per foot of dipole length with the advantage of reduced voltage levels on the antenna insulators and feedline. Production may be preferential at lower power levels once convective flow is established.

In one embodiment, the openings 26 may be positioned as illustrated in FIGS. 1 and 4, to be at opposing laterally extending end portions of the electrically conductive well pipe 24 (i.e., end portions of the dipole antenna 42). The openings 26 define a hydrocarbon resource recovery capacity. The hydrocarbon resource recovery capacity adjacent the higher electric field strength regions E is greater than the hydrocarbon resource recovery capacity adjacent the higher magnetic field strength region H. More particularly, the density of the openings adjacent the higher electric field strength regions E is greater than a density adjacent the higher magnetic field strength region H. Illustratively, no openings 26 are located adjacent the higher magnetic field strength region H. Of course, in some embodiments, the openings 26, for example, in a lower density, may be positioned adjacent the higher magnetic field strength region H at a medial portion of the well pipe 24.

Hydrocarbon resources recovered via the openings 26 typically have a higher paraffin content or are more polar than hydrocarbon resources collected from elsewhere along the electrically conductive well pipe 24. As will be appreciated by those skilled in the art, higher paraffin content hydrocarbon resources may be considered already upgraded or at or near pipeline grade as they are thinned with respect to hydrocarbon resources with a higher asphalt content, for example. Paraffinic hydrocarbon resources are relatively shiny and transparent, i.e. a wax. In contrast, bitumen produced via strip mining and a hot water bath is jet black and almost solid at −12° C., for example. Higher paraffin content hydrocarbon resources may further be used for refining higher octane gasoline, for example. Thus, increased paraffin content may be valued higher than other types of hydrocarbon resources. Table 1 below compares hydrocarbon resources recovered using a conventional technique with hydrocarbon resources recovered according to the present embodiments, wherein the openings 26 are at opposing ends of the laterally extending portion of the electrically conductive well pipe 24 (i.e., end portions of the dipole antenna 42).

TABLE 1

| Parameter | Mining | RF Process |
|---|---|---|
| Hydrocarbon Ore | Rich Athabasca Oil Sand, Canada | Rich Athabasca Oil Sand, Canada |
| Production Technique | Strip Mining followed by Clark Hot Water Process separation | RF stimulated well |
| Produced Oil Base | Asphalt | Paraffin |
| API Gravity (hydrocarbon relative density) | ~8 | ~14 |
| Viscosity in Centipoids, 20° C. | About 200,000 | 39,100 |
| Saturates | 17 | ≈20% |
| Aromatics | 39 | ≈42% |
| Selective Distillation | No | Yes |

Figure 5:
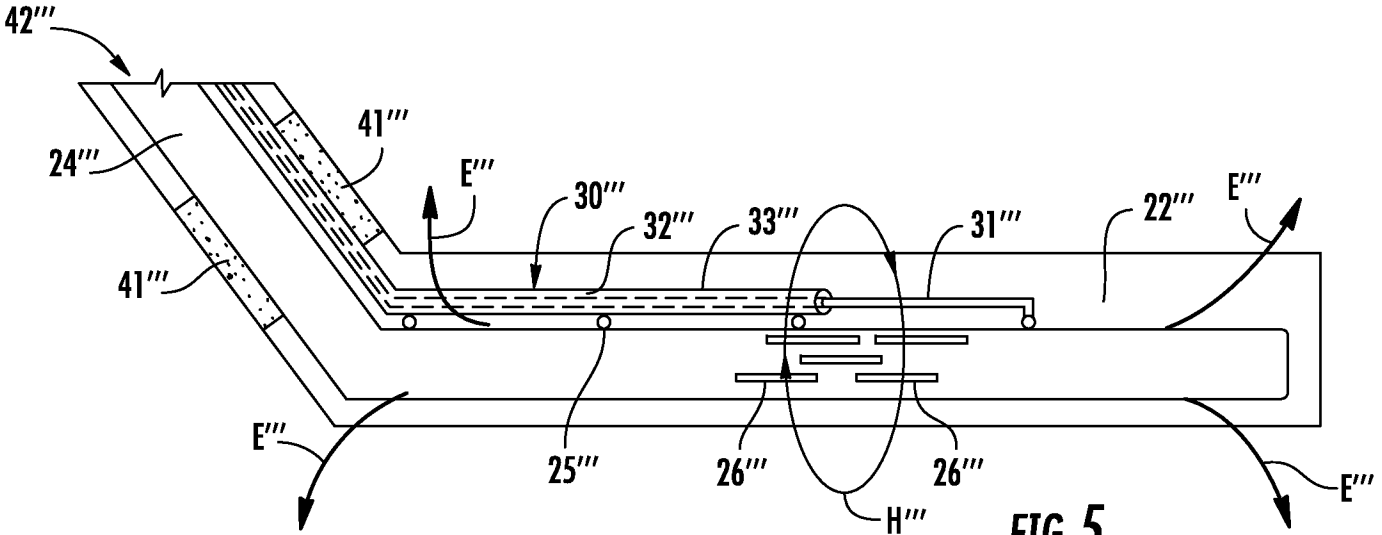
FIG. 5 is a schematic diagram of the hydrocarbon resource recovery system illustrating electric and magnetic fields according to another embodiment of the present invention.

Referring now additionally to FIG. 5, in another embodiment, the openings 26''' may be positioned so that the hydrocarbon resource recovery capacity adjacent the higher electric field strength region E''' is less than the hydrocarbon resource recovery capacity adjacent the higher magnetic field strength region H'''. More particularly, the openings 26''' may be positioned at the center or medial of the laterally extending portion of the electrically conductive well pipe 24''' or dipole antenna 42'''.

Illustratively, the density of the openings adjacent the higher magnetic field strength regions H''' is greater than a density adjacent the higher electric field strength region E'''.

No openings 26''' are located adjacent the higher electric field strength region E. Of course, in some embodiments, the openings 26, for example, in a lower density, may be positioned adjacent the higher electric field strength region E. Hydrocarbon resources recovered via the openings 26''' have a greater asphalt content than hydrocarbon resources collected from elsewhere along the electrically conductive well pipe 24'''.

Of course, the openings 26 may define additional or other hydrocarbon resource recovery capacities adjacent other or additional electric or magnetic field strength regions. In other words, the openings 26 may be positioned at different locations along the electrically conductive well pipe 24 or dipole antenna 42 to selectively recover one or more desired types of hydrocarbon resources, including radio frequency upgraded hydrocarbon resources. Additionally, varying densities of the openings 26 may be used to recover a desired type of hydrocarbon resource.

In some embodiments, the openings 26 may be closable and may be selectively opened or closed to recover hydrocarbon resources from adjacent selected portions of the electrically conductive well pipe 24 at different times, for example during RF heating. Moreover, in other embodiments the dipole antenna 42 may be moved along the length of the laterally extending wellbore 22 to selectively apply increased electric fields or magnetic fields to recover a desired type of hydrocarbon resources. By selectively recovering hydrocarbon resources subject to a higher electric field strength and/or a higher magnetic field strength, different types of hydrocarbon resources may be selectively recovered at different times.

It should also be appreciated that the concepts described above with respect to the hydrocarbon resource recovery capacity being adjacent different electric and/or magnetic field strength regions may be applied to other antenna arrangements. In other words, while a particular embodiment of a dipole antenna 42 is described herein, the concepts described above may be applicable to any or other types of antennas. Other types of antennas may include loop antennas, slot antennas, electrode antennas, folded and unfolded antennas, antenna arrays, etc. Each of these types of antennas has a unique distributions of electric currents, electric fields, and magnetic fields, which may be used to select for chemical effects in the produced materials.

A prototype model of the hydrocarbon resource recovery system 20 was formed. The prototype model was an 82:1 scale model representing a 70 foot dipole for 6.78 MHz. The prototype model included a brass tube representing the electrically conductive well pipe. A ⅛ inch 50-Ohm semi-rigid coaxial cable was coupled to and carried by the brass tube. The outer conductor of the semi-rigid coaxial cable was soldered to the brass tube at spaced apart coupling locations. A shunt feed or extension of the inner conductor extended outwardly from the semi-rigid coaxial cable and was coupled to the brass tube at the distal end of the brass tube. Of course, as noted above, altering the coupling location of the inner conductor to the brass tube alters the resistance. Eleven ferrite toroid beads were positioned around both the semi-rigid coaxial cable and the brass tube at the proximal end representing the balun. The ferrite toroid beads may be nickel zinc ferrite part No. FT-50-61, $\mu_r$=850 available from Amidon, Inc. of Costa Mesa, Calif. An adult human arm was used to simulate a saltwater load for the antenna, i.e., the heating load, having a 1.0 mhos/meter conductivity and a relative permittivity of 50. Given the 82 to 1 physical scale, the arm represented a full scale hydrocarbon ore of conductivity 1.0/82=0.012 mhos/meter, which is similar to that of very rich oil sands from the Athabasca region of Canada.

Figure 6:
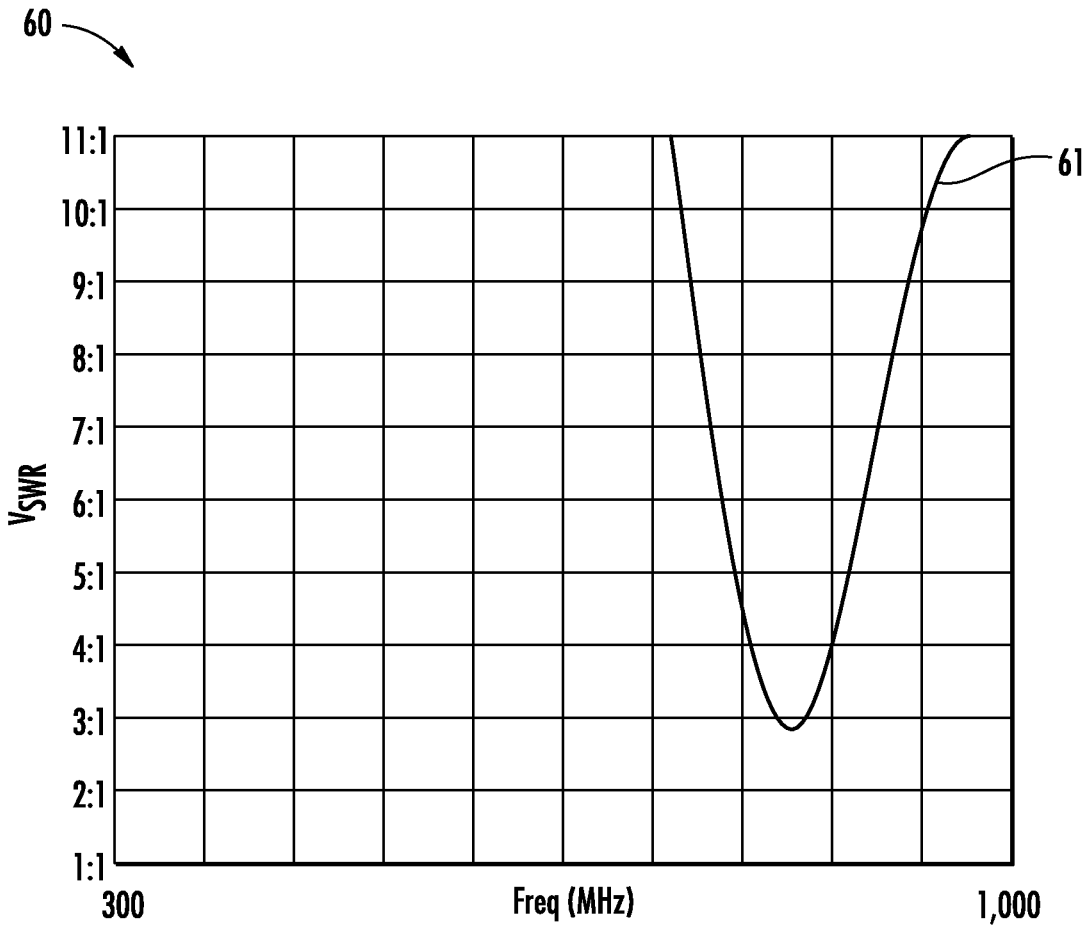
FIG. 6 is a graph of the measured voltage standing wave ratio of a small-scale prototype hydrocarbon resource recovery system in accordance with the present invention.
Figure 7:
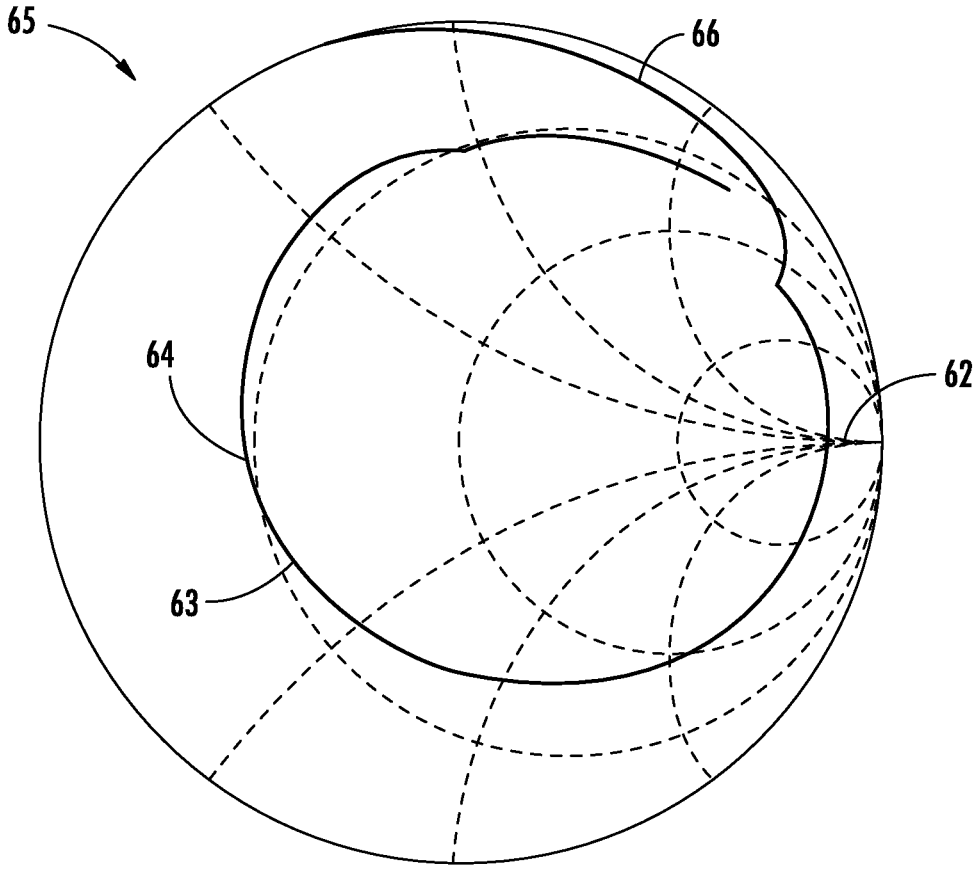
FIG. 7 is a Smith Chart of measured impedance of a small-scale prototype hydrocarbon resource recovery system in accordance with the present invention.

Referring now to the graph 60 in FIG. 6, the line 61 illustrates the measured voltage standing wave ratio (VSWR) of the prototype model described above. Illustratively, the VSWR is tuned and matched at 769 MHz with an electrical length of the antenna of $0.51\lambda_{air}$. Referring now to the Smith Chart 65 in FIG. 7, the line 66 illustrates the impedance response of the prototype model described above. Illustratively, there is 19 Ohms of resistance, which of course, is adjustable to any value. Marker 62 is at the first resonance (gamma match) of 554 MHz with an impedance of 635 Ohms. Marker 63 corresponds to 769 MHz at 19 Ohms. Marker 64 is at the second resonance (dipole) of 793 MHz with an impedance of 16 Ohms. The physical scale model was increasingly responsive to the position of the human arm/saltwater load, which may indicate relatively coupling between the antenna and the arm. A non-resonant loop "sniffer" was used to probe the distribution of magnetic fields about the model antenna, which were found to be strongest near the antenna center. A non-resonant electrically short dipole was used as a sniffer probe and the electric fields were found to be strongest near the ends of the antenna.

RF electromagnetic energies include electric currents, electric fields, and magnetic fields. Their application, the hydrocarbons, and their ores have a variety of different thermal, chemical, and mechanical effects.

The electrically conductive well pipe 24 may heat the hydrocarbon ore by magnetic field induction, electric field induction, and by dielectric heating. The electrically conductive well pipe 24 produces magnetic near fields in the ore according to Ampere's Law, which in turn cause eddy electric currents to flow there. These flowing electric currents heat the connate pore water according to the ores electrical resistance and Watts Law. The heated water then conductively heats the hydrocarbons in the ore, as hydrocarbons are generally electrically nonconductive or nearly so. The speed of heat penetration can be much greater than convection of steam. The rate of heating is related to the electric power applied to the antenna, and a broad range of radio frequencies may cause this form of heating. The realized temperatures may reach the boiling point of the water at reservoir conditions if allowed to continue for sufficient time. In electric field induction mode of heating, capacitive coupling between the electrically conductive well pipe 24 and the ore causes the electrical current to flow. In the dielectric mode of heating, electric near fields from the electrically conductive well pipe 24 heat by molecular dipole rotation within the ore. The rate of dielectric heating is related to the applied frequency and the applied power. Note that electric and magnetic field induction, and dielectric heating, typically do not require conductive electrical contact with the ore. Of course, electrode-like conduction of electrical currents may also be accomplished with bare electrically conductive well pipe 24, but the induction modes may be preferred for reliability. The mechanisms of the chemical changes that RF electromagnetic fields cause in hydrocarbon ores are relatively complex, and may be less understood than the heating effects. Testing has shown that when the electrically conductive well pipe 24 is a half wavelength long, more polar molecules are produced at the ends, and less polar molecules are produced in the middle. With stronger electric fields, dielectric breakdown of oil molecules can occur. The presence of pore water may donate hydroxyl radicals to catalyze the reactions or to donate hydrogen. In RF heating, the kinetic energies of one molecular species can be different than that of another molecular species. Higher frequencies may distill lighter weight hydrocarbons and lower frequencies heavier molecular weight hydrocarbons. For example, dodecane (diesel weight) hydrocarbons atoms have a strong resonance near 56 MHz, and propane a strong resonance near 8308 MHz.

Figure 8:
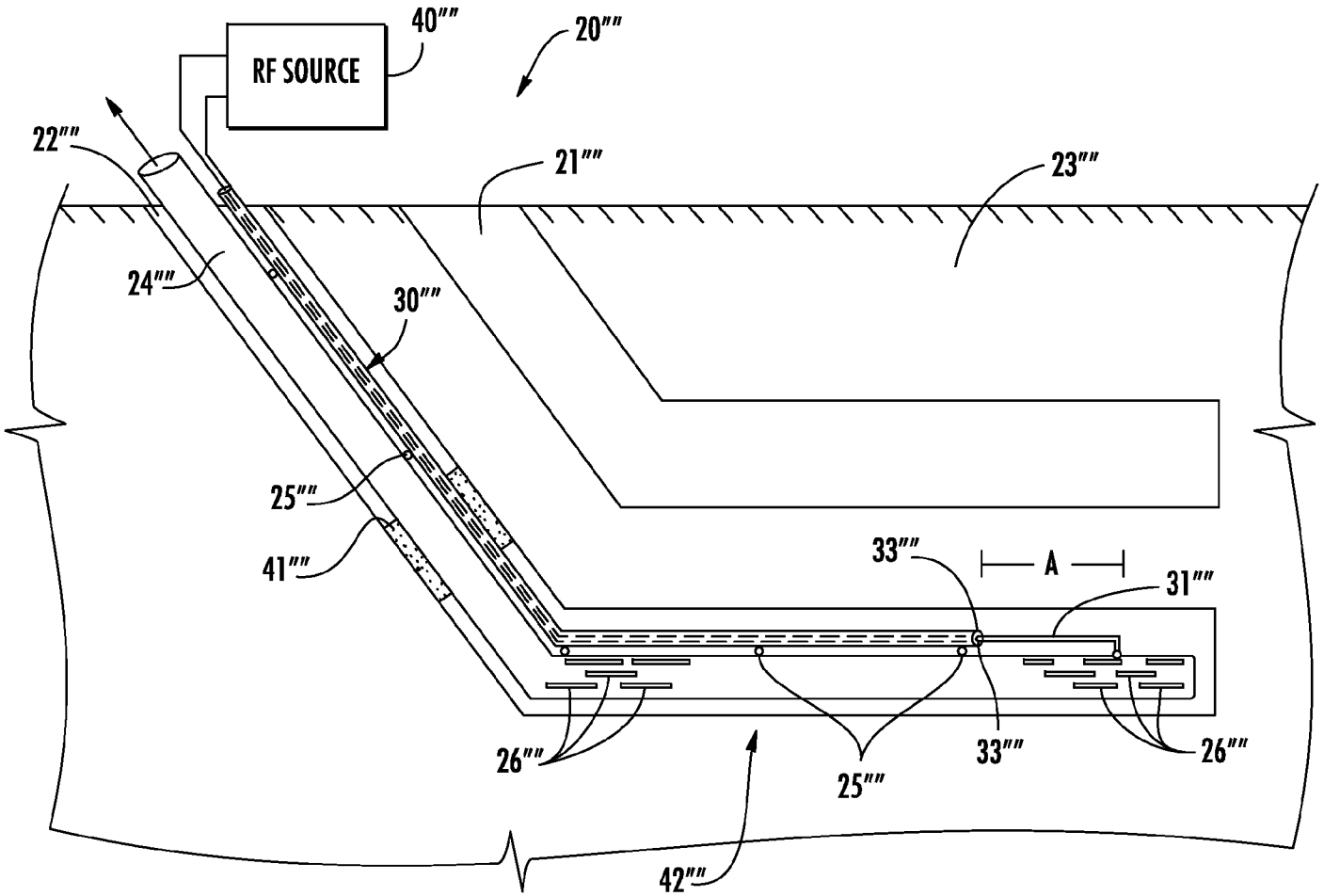
FIG. 8 is a schematic diagram of a subterranean formation including a hydrocarbon resource recovery system in accordance with another embodiment of the present invention.

Referring now to FIG. 8, in another embodiment, the hydrocarbon resource recovery system 20"" includes a pair of spaced apart first and second laterally extending wellbores 21"", 22"" in a subterranean formation 23"" containing a hydrocarbon resource. The first laterally extending wellbore 21"" may be used as an injector well and the second laterally extending wellbore 22"" may be a producer well, as in the SAGD and other related recovery techniques, for example.

A method aspect is directed to a method of recovering hydrocarbon resources in a subterranean formation 23. The method includes positioning an electrically conductive well pipe 24 extending within a laterally extending wellbore 22 in the subterranean formation 23. The method also includes supplying RF power to an RF transmission line 30 extending alongside in parallel with an exterior of the electrically conductive well pipe 24 within the laterally extending wellbore 22 and coupled to the electrically conductive well pipe to define an RF antenna for recovering the hydrocarbon resources within the subterranean formation 23.

Another method aspect is directed to a method of recovering hydrocarbon resources from a wellbore 22 in a subterranean formation containing hydrocarbon resources. The method includes positioning an antenna 42 in the wellbore 22 and operating the antenna 42 to generate a higher electric field strength region E in the subterranean formation 23 having a higher electric field strength and a lower magnetic field strength, and operating the antenna to generate a higher magnetic field strength region H in the subterranean formation having a higher magnetic field strength and a lower electric field strength. The antenna 42 has a tubular shape with openings 26 therein defining a hydrocarbon resource recovery capacity. The openings 26 are positioned so that the hydrocarbon resource recovery capacity adjacent the higher electric field strength region E is different than a hydrocarbon resource recovery capacity adjacent the higher magnetic field strength region H.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A hydrocarbon resource recovery system for a laterally extending wellbore in a subterranean formation, the hydrocarbon resource recovery system comprising:

a radio frequency (RF) source;

an electrically conductive well pipe extending within the laterally extending wellbore;

a coaxial RF transmission line coupled to said RF source and comprising an inner conductor, an outer conductor surrounding said inner conductor, and a dielectric therebetween, said coaxial RF transmission line extending alongside in parallel with an exterior of said electrically conductive well pipe within the laterally extending wellbore and coupled to said electrically conductive well pipe to define an RF antenna for heating the hydrocarbon resources within the subterranean formation; and a plurality of electrically conductive mechanical fasteners coupling said outer conductor to said electrically conductive well pipe along a length thereof.

2. The hydrocarbon resource recovery system according to claim 1, wherein said inner conductor extends outwardly beyond a distal end of said outer conductor and is coupled to said electrically conductive well pipe.

3. The hydrocarbon resource recovery system according to claim 1, wherein said electrically conductive well pipe extends beyond a distal end of said coaxial RF transmission line.

4. The hydrocarbon resource recovery system according to claim 1, further comprising a capacitor coupled in series between said inner conductor and said electrically conductive well pipe.

5. The hydrocarbon resource recovery system according to claim 1, wherein said coaxial RF transmission line is electrically coupled to said electrically conductive well pipe to define a folded dipole antenna.

6. The hydrocarbon resource recovery system according to claim 1, wherein said electrically conductive well pipe has a plurality of openings therein to collect hydrocarbon resources.

7. The hydrocarbon resource recovery system according to claim 1, further comprising a balun surrounding said coaxial RF transmission line and said electrically conductive well pipe.

8. An RF antenna assembly to be positioned within a laterally extending wellbore in a subterranean formation for hydrocarbon resource recovery, the RF antenna assembly comprising:

an electrically conductive well pipe extending within the laterally extending wellbore; and an RF transmission line extending alongside in parallel with an exterior of said electrically conductive well pipe within the laterally extending wellbore and coupled to said electrically conductive well pipe;

wherein said RF transmission line comprises a coaxial RF transmission line comprising an inner conductor, an outer conductor surrounding said inner conductor, and a dielectric therebetween;

and further wherein said outer conductor is coupled to said electrically conductive well pipe along a length thereof by a plurality of electrically conductive mechanical fasteners.

9. The RF antenna assembly according to claim 8, wherein said inner conductor extends outwardly beyond a distal end of said outer conductor and is coupled to said electrically conductive well pipe.

10. The RF antenna assembly according to claim 8, wherein said electrically conductive well pipe extends beyond a distal end of said coaxial RF transmission line.

11. The RF antenna assembly according to claim 8, wherein said coaxial RF transmission line is electrically coupled to said electrically conductive well pipe to define a folded dipole antenna.

12. The RF antenna assembly according to claim 8, wherein said electrically conductive well pipe has a plurality of openings therein to collect hydrocarbon resources.

13. A method of recovering hydrocarbon resources in a subterranean formation comprising:

positioning an electrically conductive well pipe within a laterally extending wellbore in the subterranean formation;

positioning a radio frequency (RF) transmission line alongside in parallel with an exterior of the electrically conductive well pipe within the laterally extending wellbore;

electrically coupling the RF transmission line to the electrically conductive well pipe to define an RF antenna for recovering the hydrocarbon resources within the subterranean formation;

supplying RF power to the RF transmission line;

further comprising forming the RF transmission line as an RF coaxial transmission line comprising an inner conductor, an outer conductor surrounding the inner conductor, and a dielectric therebetween;

and further comprising coupling the outer conductor to the electrically conductive well pipe along a length thereof, the coupling comprising a plurality of electrically conductive mechanical fasteners.

14. The method according to claim 13, further comprising disposing the inner conductor such that it extends outwardly beyond a distal end of the outer conductor; and coupling the inner conductor to the electrically conductive well pipe.

15. The method according to claim 13, further comprising positioning the electrically conductive well pipe to extend beyond a distal end of the coaxial RF transmission line.

16. The method according to claim 13, further comprising coupling a capacitor in series between the inner conductor and the electrically conductive well pipe.

17. The method according to claim 13, further comprising coupling the coaxial RF transmission line to the electrically conductive well pipe to define a folded dipole antenna.

* * * * *